US011867438B2

(12) United States Patent
Spryshak et al.

(10) Patent No.: US 11,867,438 B2
(45) Date of Patent: Jan. 9, 2024

(54) MULTIPLE EXPANSION DEVICE EVAPORATORS AND HVAC SYSTEMS

(71) Applicant: Air International (US) Inc., Auburn Hills, MI (US)

(72) Inventors: Joseph J. Spryshak, Hartland, MI (US); Brendan Stewart McClanahan, Auburn Hills, MI (US)

(73) Assignee: Air International (US) Inc., Auburn Hills, MI (US)

( * ) Notice: Subject to any disclaimer, the term of this patent is extended or adjusted under 35 U.S.C. 154(b) by 7 days.

(21) Appl. No.: 17/698,388

(22) Filed: Mar. 18, 2022

(65) Prior Publication Data

US 2023/0160613 A1 May 25, 2023

Related U.S. Application Data

(60) Provisional application No. 63/289,386, filed on Dec. 14, 2021, provisional application No. 63/281,955, filed on Nov. 22, 2021.

(51) Int. Cl.
*F25B 41/325* (2021.01)
*F25B 13/00* (2006.01)

(52) U.S. Cl.
CPC ..... *F25B 41/325* (2021.01); *F25B 13/00* (2013.01)

(58) Field of Classification Search
CPC ..... F25B 41/325; F25B 13/00; F25B 5/02; F25B 39/028; F25B 41/42; F28D 1/0408
See application file for complete search history.

(56) References Cited

U.S. PATENT DOCUMENTS

| | | | | |
|---|---|---|---|---|
| 6,105,387 | A | 8/2000 | Hong et al. | |
| 2012/0241139 | A1 | 9/2012 | Katoh et al. | |
| 2017/0167758 | A1* | 6/2017 | Tsai | F25B 5/02 |
| 2018/0180335 | A1* | 6/2018 | Kamoshida | B60H 1/3227 |
| 2018/0283748 | A1* | 10/2018 | Lee | F28D 1/05391 |

(Continued)

FOREIGN PATENT DOCUMENTS

| | | | |
|---|---|---|---|
| DE | 20208337 | U1 | 10/2003 |
| EP | 2314957 | A2 | 4/2011 |
| FR | 3101576 | A1 | 4/2021 |

(Continued)

OTHER PUBLICATIONS

Pdf is translation of foreign reference JP-201188795-A (Year: 2020).*

(Continued)

*Primary Examiner* — Henry T Crenshaw
*Assistant Examiner* — Kamran Tavakoldavani
(74) *Attorney, Agent, or Firm* — Carlson, Gaskey & Olds, P.C.

(57) ABSTRACT

An HVAC system includes an evaporator, a condenser, a compressor. A first refrigerant path flows through a first expansion valve, first evaporator inlet, within the evaporator, and out of the evaporator through a first evaporator outlet. A second refrigerant path flows through a second expansion valve, a second evaporator inlet, within the evaporator, and out of the evaporator through a second evaporator outlet. Refrigerant flows from the condenser to the first refrigerant path and the second refrigerant path, and from the first refrigerant path and the second refrigerant path to the compressor.

20 Claims, 9 Drawing Sheets

(56) References Cited

U.S. PATENT DOCUMENTS

2019/0360731 A1* 11/2019 Dixit ..... F25B 41/24

FOREIGN PATENT DOCUMENTS

JP 2021188795 A * 5/2020
KR 20170013765 A * 7/2015 ..... F25B 39/02

OTHER PUBLICATIONS

Pdf is translation of foreign reference KR-20170013765-A (Year: 2015).*
International Search Report for International Application No. PCT/US2022/042718 dated Dec. 6, 2022.

* cited by examiner

MULTIPLE EXPANSION DEVICE EVAPORATORS AND HVAC SYSTEMS

CROSS-REFERENCED TO RELATED APPLICATION

This application claims priority to U.S. Provisional Application No. 63/281,955, which was filed on Nov. 22, 2021, and U.S. Provisional Application No. 63/289,386, which was filed on Dec. 14, 2021.

BACKGROUND

Vehicles may have a HVAC (Heating, ventilation, and air conditioning) climate control system located within an instrument panel which provides conditioned air, such as by heating or cooling or dehumidifying, through various outlets to occupants in the vehicle cabin.

SUMMARY

An HVAC system according to an example of this disclosure includes an evaporator, a condenser, a compressor. A first refrigerant path flows through a first expansion valve, first evaporator inlet, within the evaporator, and out of the evaporator through a first evaporator outlet. A second refrigerant path flows through a second expansion valve, a second evaporator inlet, within the evaporator, and out of the evaporator through a second evaporator outlet. Refrigerant flows from the condenser to the first refrigerant path and the second refrigerant path, and from the first refrigerant path and the second refrigerant path to the compressor.

In a further example of the foregoing, a receiver drier is fluidly between, with respect to the flow of refrigerant, the condenser and the first and second expansion valves.

In a further example of any of the foregoing, the evaporator includes a first tube row, which includes a first plurality of evaporator tubes spaced apart from one another in a lengthwise direction and extending in a heightwise direction. A second tube row includes a second plurality of evaporator tubes spaced apart from one another in the lengthwise direction and extending in a heightwise direction. The first plurality of evaporator tubes are spaced from the second plurality of evaporator tubes in a widthwise direction.

In a further example of any of the foregoing, a first tank at a first end of the first tube row and the second tube row, and a second tank at a second end of the first tube row and the second tube row and opposite the first end.

In a further example of any of the foregoing, the first evaporator inlet and the second evaporator inlet are disposed at the second tank.

In a further example of any of the foregoing, the first evaporator outlet and the second evaporator outlet are disposed at the second tank.

In a further example of any of the foregoing, a fan is configured to move air in the widthwise direction across the evaporator. The second tube row is an air on tube row with respect to the airflow of the fan.

In a further example of any of the foregoing, the first tube row is an air off tube row with respect to the airflow of the fan.

In a further example of any of the foregoing, a plurality of partitions within the first and second tanks are configured to direct refrigerant flow within the evaporator and to keep the first refrigerant path and the second refrigerant path fluidly separate within the evaporator.

In a further example of any of the foregoing, the first refrigerant path is configured flows to enter one of the first and second tank through the first evaporator inlet, through a first subsection of the first plurality of evaporator tubes in the heightwise direction to the other of the first and second tank, through a first subsection of the second plurality of evaporator tubes in an opposite heightwise direction back to the one of the first and second tank, and exits the evaporator through the first evaporator outlet on the of the first and second tank.

In a further example of any of the foregoing, the second refrigerant path is flows to enter the of the first and second tank through the second evaporator inlet, through a second subsection of the first plurality of evaporator tubes in the heightwise direction to other of the first and second tank, then through a second subsection of the second plurality of evaporator tubes in the opposite heightwise direction back to the one of the first and second tank, and exits the evaporator through the second evaporator outlet on one of the first and second tank.

In a further example of any of the foregoing, a plurality of partitions within the first and second tanks direct refrigerant flow within the evaporator and keep the first refrigerant path and the second refrigerant path fluidly separate within the evaporator.

In a further example of any of the foregoing, the first tube row, the second tube row, the first tank, and the second tank, are brazed together.

In a further example of any of the foregoing, the first refrigerant path and the second refrigerant path have a mirrored relationship within the evaporator relative to a plane, which extends widthwise and heightwise through central portions of the first and second tube row.

In a further example of any of the foregoing, the opposite heightwise direction is a downward direction.

In a further example of any of the foregoing, the opposite heightwise direction is an upward direction.

In a further example of any of the foregoing, at least one of the first and second expansion valves are in communication with a controller to vary refrigerant flow through the at least one of the first and second expansion valves.

In a further example of any of the foregoing, the first tube row, the second tube row, the first tank, and the second tank, are brazed together.

In a further example of any of the foregoing, a plurality of fins extend in the lengthwise direction between adjacent ones of the first and second plurality of evaporator tubes and in the widthwise direction from the second tube row to the first tube row.

In a further example of any of the foregoing, the first evaporator inlet and the second evaporator inlet are disposed at the second tank, and the first evaporator outlet and the second evaporator outlet are disposed at the second tank.

These and other features may be best understood from the following specification and drawings, the following of which is a brief description.

DETAILED DESCRIPTION

This disclosure is related to HVAC systems, and more particularly to an evaporator having two or more refrigerant paths.

Figure 1:
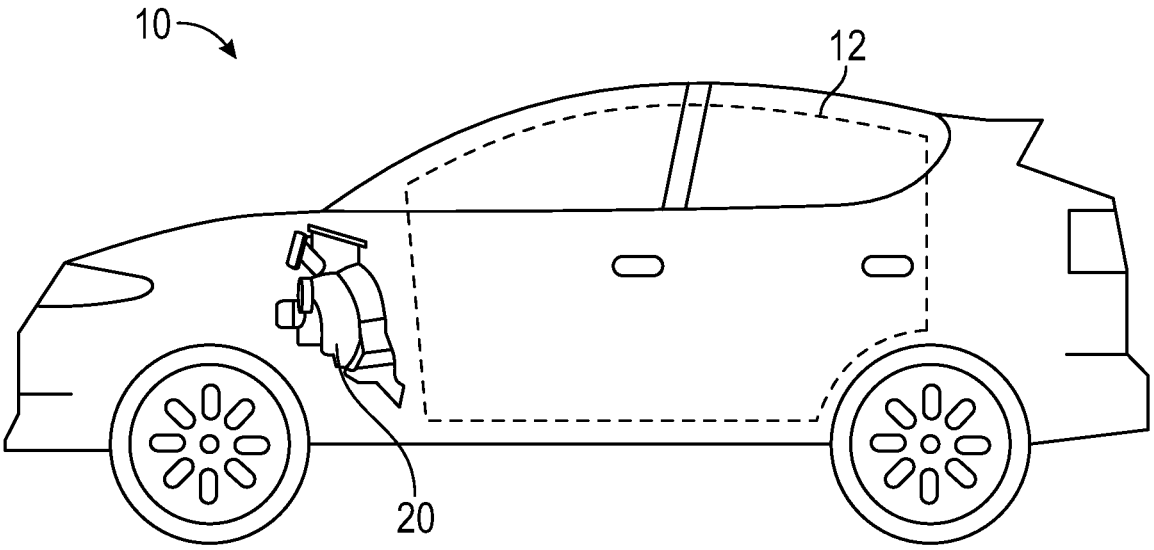
FIG. 1 schematically illustrates an example HVAC system in a vehicle.

FIG. 1 illustrates a vehicle 10 including an example HVAC system 20 for providing conditioned air to a vehicle cabin 12. In some examples, the vehicle 10 may include any of automobiles, heavy trucks, agricultural vehicles, or commercial vehicles.

Figure 2:
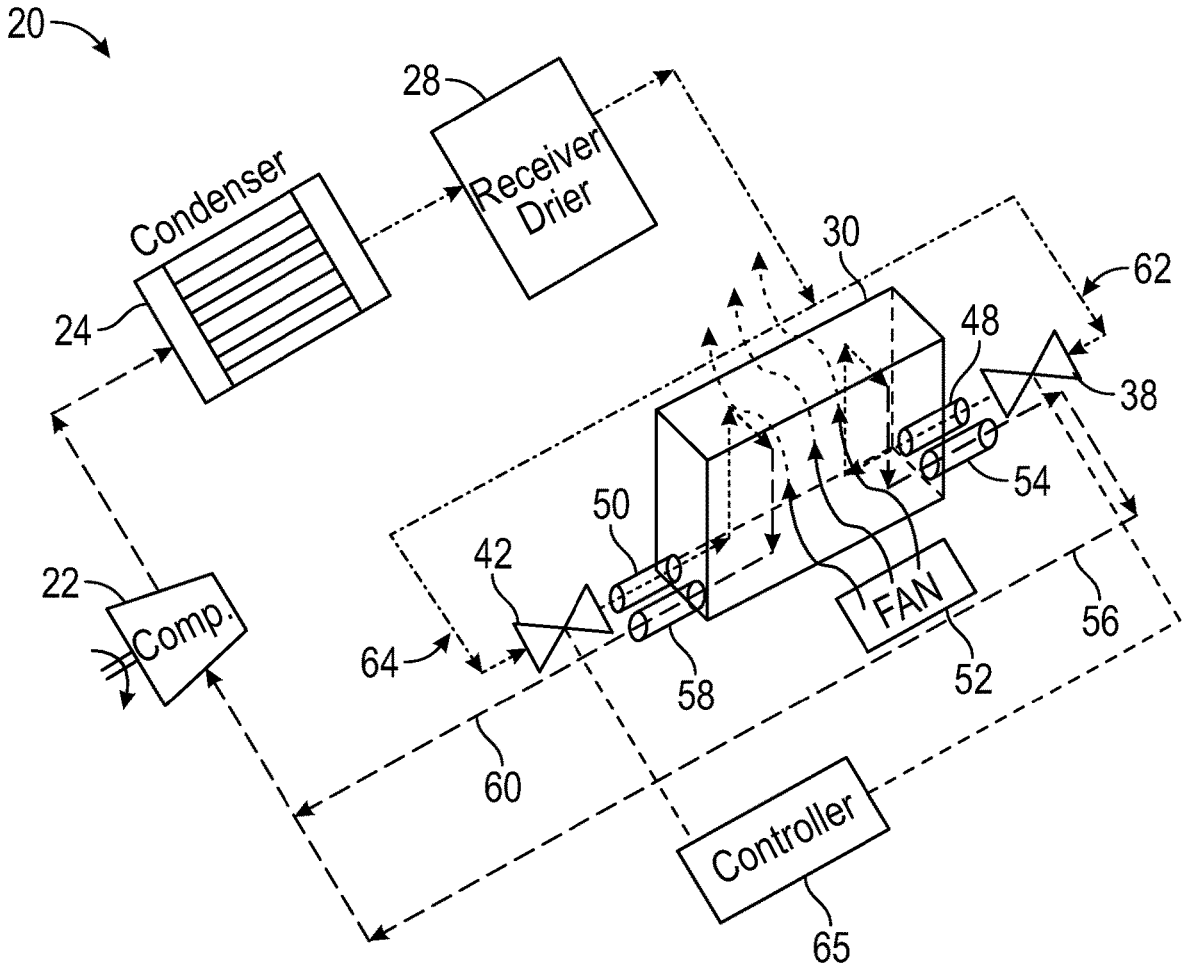
FIG. 2 schematically illustrates the example HVAC system of FIG. 1.

FIG. 2 schematically illustrates the example HVAC system 20 of FIG. 1. The example HVAC system 20 includes a compressor 22, condenser 24, evaporator 30 and two expansion valves 38, 42. In some examples, as shown, the HVAC system 20 includes a receiver drier 28. Refrigerant enters the compressor 22 as low-pressure, low-temperature gas, and leaves the compressor 22 as a high-pressure, high-temperature gas, flowing to the condenser 24. The condenser 24 is supplied with high-temperature high-pressure, vaporized refrigerant coming off the compressor 22 and removes heat from the hot refrigerant vapor until it condenses into a saturated liquid state. The expansion devices 38, 42 each create a drop in pressure after the refrigerant leaves the condenser 24 and before refrigerant enters the evaporator 30.

As shown, the refrigerant splits into a first path 62 flowing across the expansion valve 38 and entering the evaporator 30 at a first evaporator inlet 48 and a second, separate path 64 flowing across the expansion valve 42 and entering the evaporator 30 at a second evaporator inlet 50. The example expansion valves 38, 42 as shown are electronic expansion valves; however, in some examples, other valves, including mechanical expansion valves, may be utilized. Refrigerant enters the evaporator 30 as a low temperature liquid at low pressure, and a fan 52 forces air across the evaporator 30, cooling the air by absorbing the heat from the space in question into the refrigerant. The refrigerant entering the evaporator 30 through the evaporator inlet 48 exits through an evaporator outlet 54 and flows back to the compressor 22 through a first exit path 56, and the refrigerant entering the evaporator 30 through the evaporator inlet 50 exits through an evaporator outlet 58 and flows back to the compressor 22 through a second exit path 60. In some examples, as shown, a receiver drier 28 is fluidly between, with respect to the flow of refrigerant, the condenser 24 and evaporator 30, to clean and remove moisture from the system.

The system 20 therefore includes a first refrigerant path 62 including flow through the first expansion valve 38, the first evaporator inlet 48, within the evaporator 30, and exiting the evaporator 30 through the first evaporator outlet 54. The system further includes a second refrigerant path 64 including flow through a second expansion valve 42, a second evaporator inlet 50, within the evaporator 30, and exiting the evaporator 30 through a second evaporator outlet 58. Refrigerant flows from the condenser 24 to the first refrigerant path 62 and the second refrigerant path 64, and from the first refrigerant path 62 and the second refrigerant path 64 to the compressor 22. In some examples, the paths 62 and 64, via their respective exit paths 56 and 60, connect to the compressor 22 at different stages of compression from one another. In some examples, the paths 62 and 64, via their respective exit paths 56 and 60, connect to the compressor 22 at the same stage of compression.

One or both of the first and second expansion valves 38, 42 may be selectively controllable to vary refrigerant flow therethrough. In some examples, as shown, one or both of the first and second expansion valves 38, 42 may be in communication with one or more controllers 65 to control the flow of refrigerant therethrough. The one or more controllers 65, in some examples, may include one or more computing devices, each having one or more of a computer processor, memory, storage means, network device and input and/or output devices and/or interfaces. The memory may, for example, include UVPROM, EEPROM, FLASH, RAM, ROM, DVD, CD, a hard drive, or other computer readable medium which may store data and/or the algorithms corresponding to the various functions of this disclosure. Although one controller 65 is schematically illustrated for discussion purposes, multiple controllers, including a controller at each expansion valve 38, 42, which may be separate from or integrated with the expansion valves 38, 42, may be utilized in some examples. Those skilled in the art who have the benefit of this description will realize that combination of hardware, software or firmware will best suit their particular needs. In some examples, flow through each expansion valve 38, 42 can be independently varied to achieve desired temperatures, pressures, and/or efficiency within the system.

In some examples, independent control may allow for closing or adjusting one expansion valve 38, 42 to prevent or reduce flow on one side of the evaporator. This would allow the pumping power of the compressor to be less overall with half the evaporator being utilized. Half mass flow of the refrigerant would be pumped through half of the evaporator. This condition may be for dehumidifying and or cooling air for only the driver side of the vehicle while not dehumidifying or cooling the passenger side, as an example. This would allow for reduction in compressor power when the passenger is not present. Further, independent control may allow for increase in the heat exchange from air to refrigerant within the same package envelope, as well as improvement of the temperature uniformity of the air exiting the evaporator.

Refrigerant properties in the saturation range are such that at a given pressure, there is a single associated refrigerant temperature, such that, as the pressure increases within the saturation zone, the temperature also increases. More heat is absorbed from the air as the refrigerant temperature lowers. At the refrigerant exit of the evaporator, the pressure is set by system conditions, including compressor RPM, condenser heat exchange, refrigerant charge amount, condenser subcool, and evaporator superheat. At the refrigerant inlet of the evaporator, the pressure equals the exit pressure plus the refrigerant pressure drop within the evaporator. By reducing the refrigerant pressure drop within the evaporator, the inlet pressure drop will be less, if all other conditions are being held constant. Since pressure determines the temperature when the refrigerant is saturated, the temperature of the refrigerant will also be lower at the refrigerant inlet. The lower refrigerant temperature will increase the temperature differential between the heat exchange media and increase the heat transfer. Increasing the temperature differential increases heat exchange rates in both conduction and convection. This in turn results in more heat exchange in the heat exchanger.

Although FIG. 2 is shown as an example HVAC system configuration, the evaporators disclosed herein could be utilized in other configurations in some examples.

Figure 3:
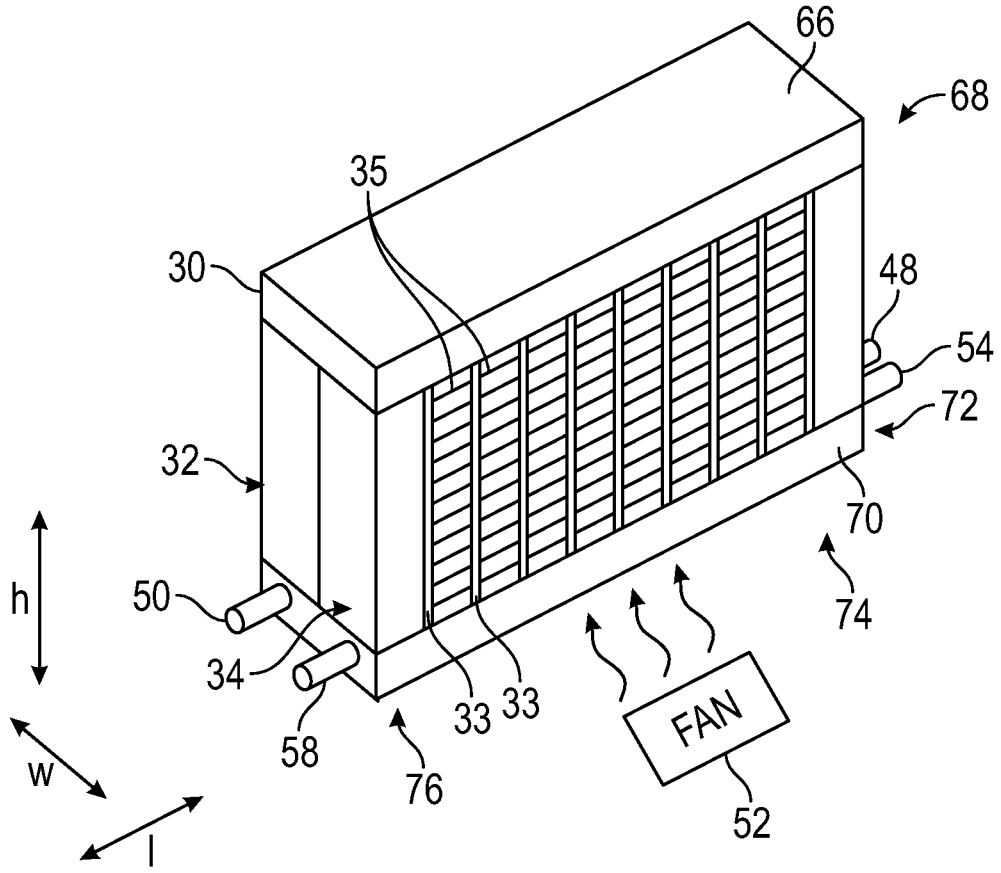
FIG. 3 schematically illustrates an example evaporator of the example HVAC system of FIGS. 1 and 2.
Figure 11:
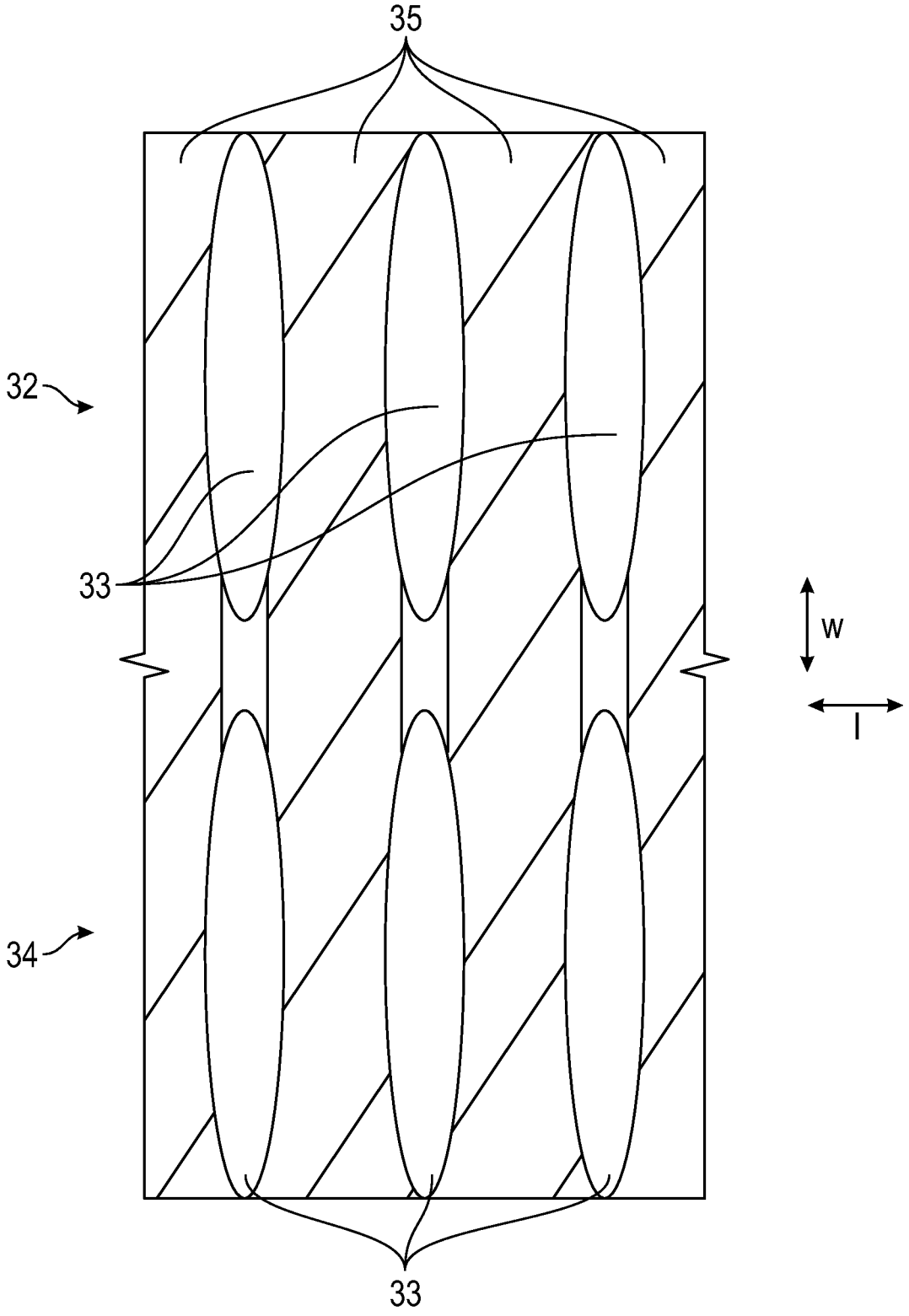
FIG. 11 shows a sectional view of an example evaporator.

FIG. 3 schematically illustrates the example evaporator 30 including a first tube row 32 and a second tube row 34 spaced widthwise w from the first tube row 32. Each tube row 32, 34 includes a plurality of evaporator tubes 33 positioned adjacent one another in a lengthwise 1 direction and extending in a heightwise h direction. A plurality of fins 35 spaced apart in a heightwise h direction may extend lengthwise between adjacent tubes 33 and widthwise across both the first tube row 32 and the second tube row 34, as shown in FIG. 11. Referring back to FIG. 3, the evaporator 30 includes a first tank 66 at a first end 68 of the first tube row 32 and the second tube row 34, and a second tank 70 at a second end 72 of the first tube row 32 and the second tube row 34 and opposite the first end 68 in the heightwise direction. The first tank 66 provides internal fluid paths and is in fluid communication with the evaporator tubes 33 of each of the first tube row 32 and a second tube row 34. The second tank 70 provides internal fluid paths and is in fluid communication with the evaporator tubes 33 of each of the first tube row 32 and a second tube row 34.

In the example evaporator 30, the first evaporator inlet 48 and the first evaporator outlet 54 are disposed at a first lengthwise tank end 74 of the second tank 70. The second evaporator inlet 50 and the second evaporator outlet 58 are disposed at a second lengthwise tank end 76 of the second tank 70 opposite the tank from the first end 74.

In the example evaporator 30, the first tube row 32, the second tube row 34, the first tank 66, and the second tank 70 are joined together as one evaporator 30. In some examples, the example evaporator 30 the first tube row 32, the second tube row 34, the first tank 66, and the second tank 70 are joined together by brazing.

In some examples, air flow across the evaporator 30 is substantially in the widthwise direction and perpendicular to the evaporator tubes 33, such that one of the first and second tube rows 32, 34 is an "air on" tube row and the other of the first and second tube rows is an "air off" tube row. The "air on" tube row is upstream of the "air off" tube row with respect to the direction of fan airflow. As shown with respect to the example evaporator 30, the fan 52 is positioned nearest the second tube row 34, such that the second tube row 34 is the "air on" tube row, and the first tube row 32 is the "air off" tube row.

Figure 4:
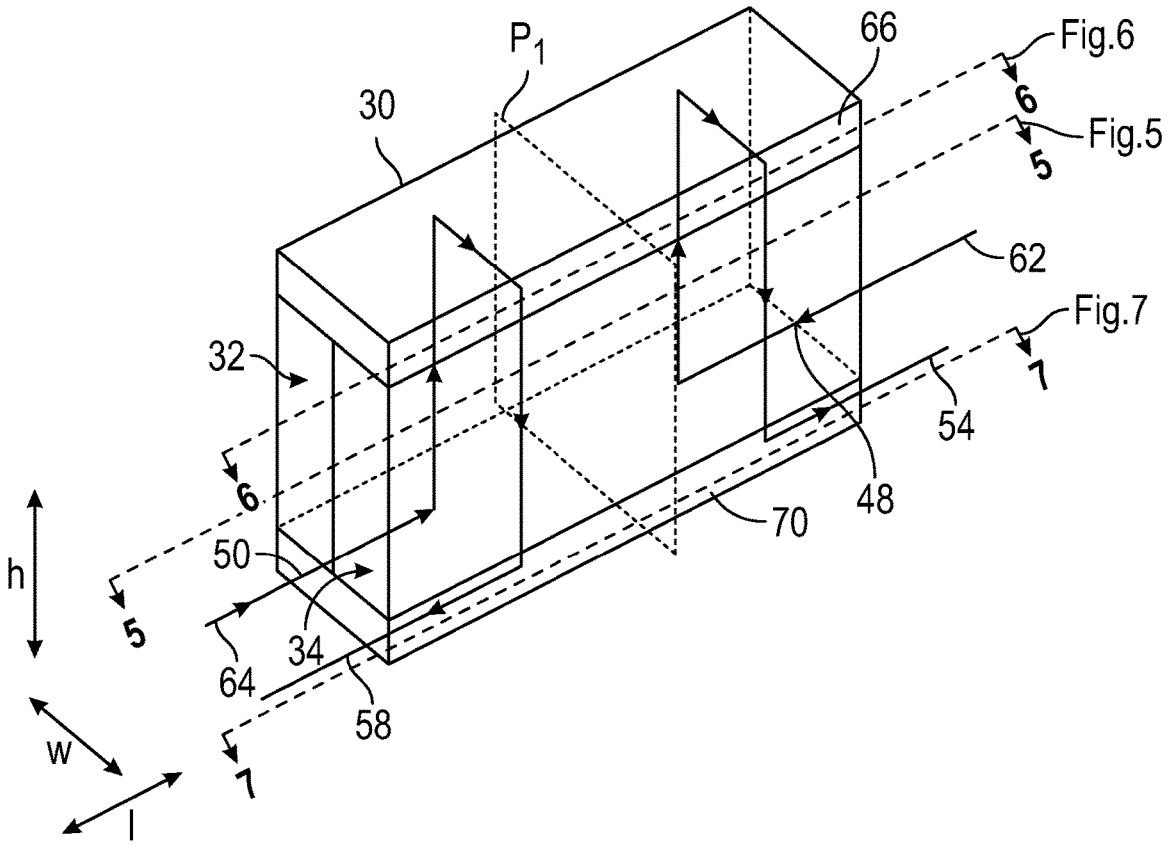
FIG. 4 schematically illustrates the example evaporator of FIG. 3.

FIG. 4 schematically illustrates the refrigerant flow path through the example evaporator 30. In the path 62, refrigerant enters the second tank 70 through the first evaporator inlet 48, flows through a subsection 78 (See FIG. 5) of the evaporator tubes 33 of the first tube row 32 in a heightwise direction to the first tank 66, then through a subsection 80 (See FIG. 5) of the evaporator tubes 33 of the second tube row 34 in an opposite heightwise direction back to the second tank 70, and exits the evaporator 30 through the first evaporator outlet 54 on the second tank 70. In some examples, each subsection 78, 80, 82, 84 extends approximately half the length of the evaporator 30.

Figure 5:
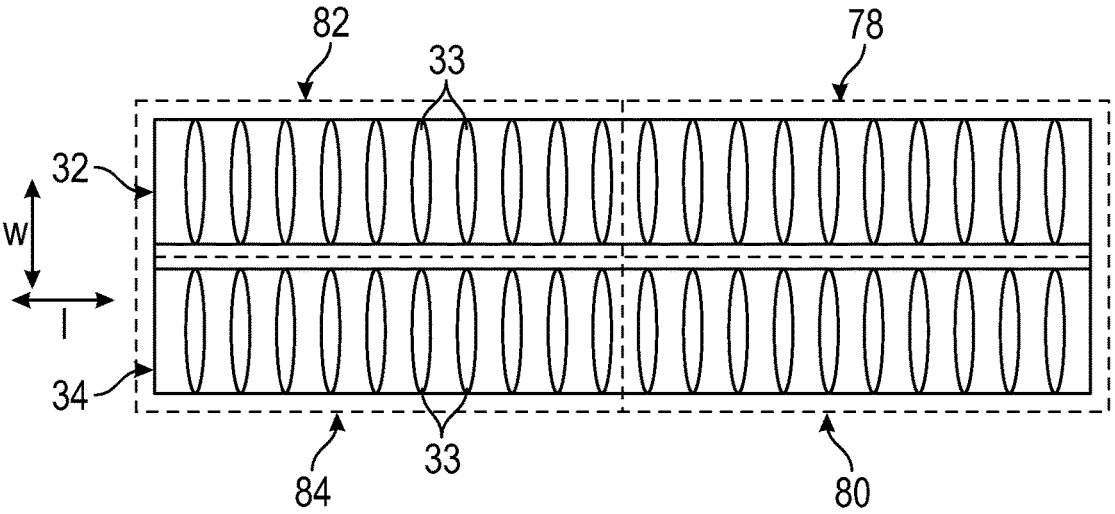
FIG. 5 illustrates a cross-sectional view of the example evaporator of FIGS. 3-4.

As shown in FIGS. 4 and 5, in the path 64, refrigerant may also enter the second tank 70 through the second evaporator inlet 50, flow through a subsection 82 (See FIG. 5) of the evaporator tubes 33 of the first tube row 32 in a heightwise direction to the first tank 66, then through a subsection 84 (see FIG. 5) of the evaporator tubes 33 of the second tube row 34 in an opposite heightwise direction back to the second tank 70, and exits the evaporator 30 through the second evaporator outlet 58 on the second tank 70.

Referring to FIG. 4, in some examples, the refrigerant paths 62 and 64 within the evaporator 30 may be configured in a mirrored relationship to one another relative to a plane P1 extending heightwise and widthwise through the center of the tube rows 32, 34 as shown. In some examples, as shown, in each refrigerant path 62, 64 refrigerant enters the evaporator 30 through the "air off" tube row and exits through the "air on" tube row. In such configurations, the temperature difference between air flowing across evaporator 30 and the refrigerant throughout the flow paths 62, 64 is maximized such that the "air off" tube row will be a desirably low temperature. In this configuration, the refrigerant may be a superheated vapor when it is located on the "air on" side, making the temperature higher than when it was previously a saturated mixture of vapor and liquid at the "air off" side, resulting in air exiting the evaporator 30 at the lowest refrigerant temperature side.

Figure 6:
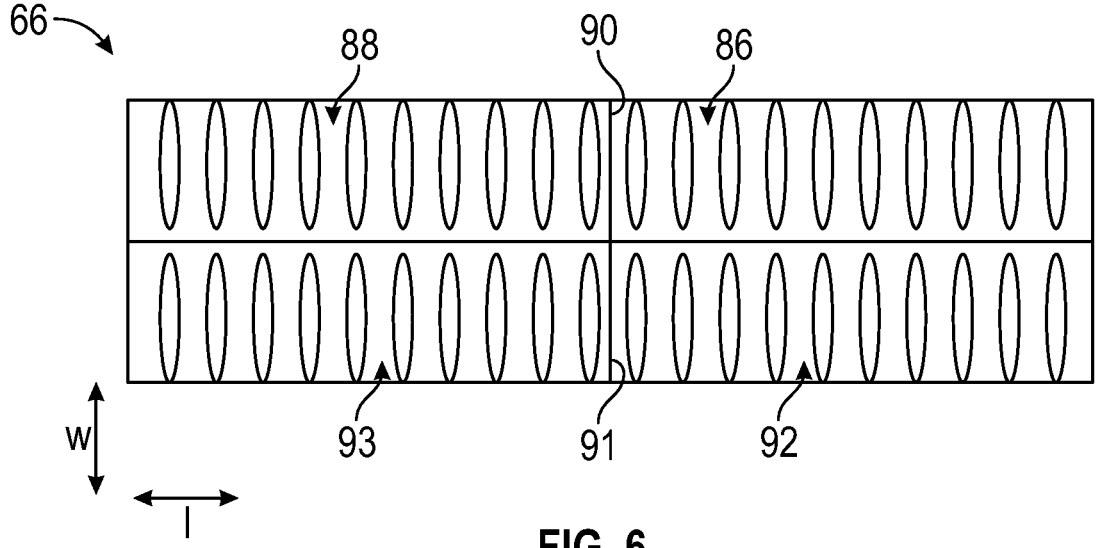
FIG. 6 illustrates another cross-sectional view of the example evaporator of FIGS. 3-5.

As shown in FIG. 6, the tanks 66, 70 may include one or more partitions to direct refrigerant flow within the evaporator and keep the first refrigerant path 62 and the second refrigerant path 64 (reference FIG. 2) fluidly separate within the evaporator 30. As shown in FIG. 6, the first tank 66 includes a first tank subsection 86 in fluid communication with the subsection 78 of evaporator tubes 33 (See FIG. 5) and a second tank subsection 88 in fluid communication with the subsection 82 of evaporator tubes 33 (See FIG. 5), and a partition 90 extending widthwise and heightwise fluidly separates the first tank subsection 86 from the second tank subsection 88. A partition 91 substantially aligned lengthwise with the partition 90 extends widthwise and heightwise and fluidly separates a third tank subsection 92 (in fluid communication with tube subsection 80) from the second tank subsection 93 (in fluid communication with tube subsection 84). In some examples, each subsection 86, 88, 92, 93 extends approximately half the length of the evaporator 30.

Figure 7:
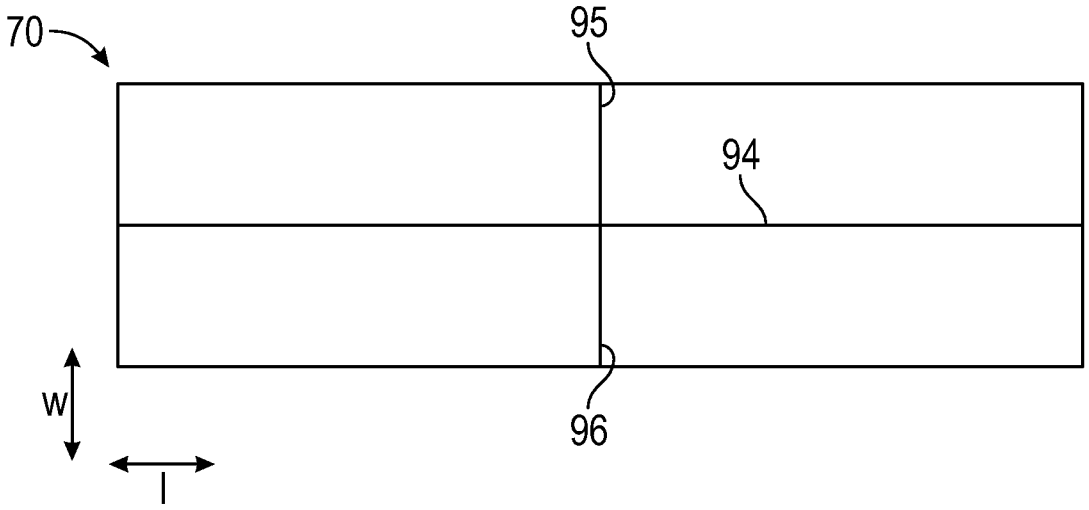
FIG. 7 illustrates another cross-sectional view of the example evaporator of FIGS. 3-6.

FIG. 7 shows a cross section through the second tank 70. A partition 94 extending lengthwise and heightwise and aligned widthwise between the first and second tube rows 32, 34 (see FIG. 4) fluidly separates a first tube row side of the second tank 70 from a second tube row side of the second tank 70 in order to achieve the flow paths shown in FIG. 4. Partitions 95 and 96 are also provided and positioned similarly to partitions 90, 91 of the first tank 66 shown in FIG. 6.

Figure 8:
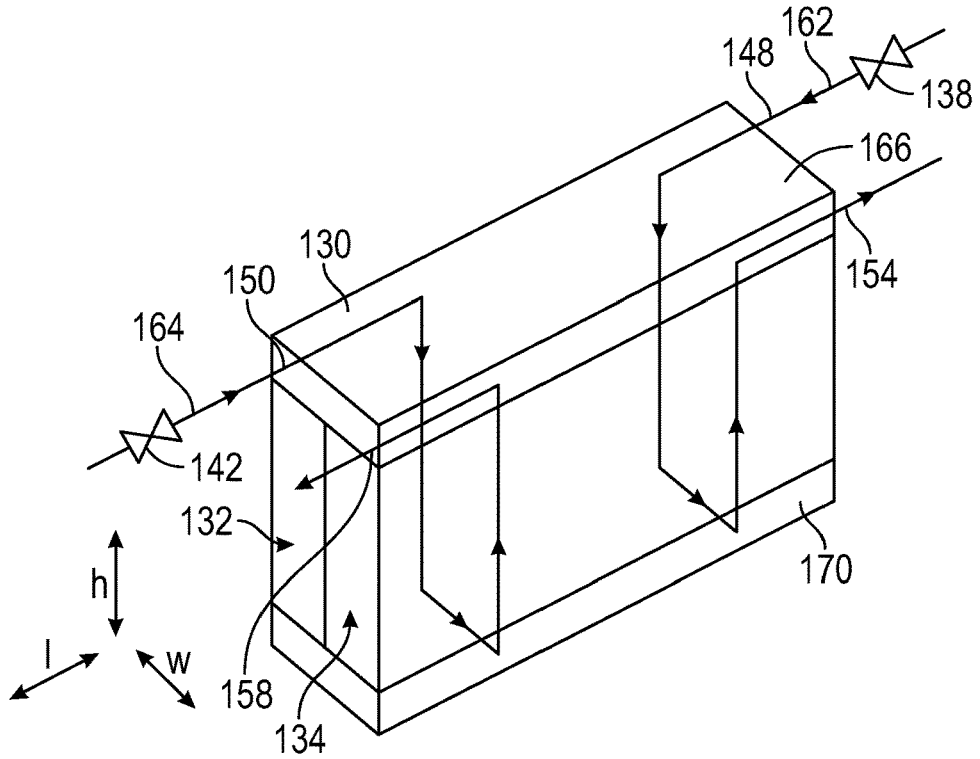
FIG. 8 schematically illustrates a section of another example HVAC system.

Although an example refrigerant pass configuration is shown in FIGS. 2-7, pass configurations through each tube row could be varied to achieve desired performance FIG. 8 illustrates another example evaporator 130 substantially similar to the example evaporator 30, except that both refrigerant paths 162, 164 enter and exit the evaporator 130 through the tank 166 instead of the tank 170. It should be understood that like reference numerals identify corresponding or similar elements throughout the several drawings. The evaporator 130 may be utilized in an HVAC system similar or identical to the system 20 shown in FIG. 2 in some examples. In some examples, with respect to FIG. 1, the tanks 66/166 are upper tanks with respect to the normal orientation of the vehicle 10, and the tanks 70/270 are lower tanks with respect to the normal orientation of the vehicle 10. Similar to the configuration of the evaporator 30, both refrigerant paths enter the example evaporator 130 on the "air off" side and exit the evaporator 130 on the "air on" side.

In the path 162, refrigerant enters the first tank 166 through the first evaporator inlet 148, flows through a subsection (the subsections may be configured the same or similar as in FIG. 5 in some examples) of the evaporator tubes of first tube row 132 in a heightwise direction to the second tank 170, then through a subsection of the evaporator tubes of the second tube row 134 in an opposite heightwise direction back to the first tank 166, and exits the evaporator 130 through the first evaporator outlet 154 on the first tank 166. The inlet 148 and outlet 166 are at the same lengthwise side of the tank 166 as one another.

In the path 164, refrigerant may also enter the first tank 166 through the second evaporator inlet 150, flow through a subsection of the evaporator tubes of the first tube row 32 in a heightwise direction to the second tank 170, then through a subsection of the evaporator tubes of the second tube row 134 in an opposite heightwise direction back to the first tank 166, and exits the evaporator 130 through the second evaporator outlet 158 on the first tank 166. The inlet 150 and outlet 158 are at the same lengthwise side of the tank 166 as one another.

In this example, the refrigerant in each path 162, 164 flows in the upward heightwise direction through the second tube row 134, with respect to the normal orientation of the vehicle 10, as it nears the outlets 154/158. Further, the refrigerant flows in the downward heightwise direction through the tube row 132 with respect to the normal orientation of the vehicle 10. When in the tube row 132, the refrigerant is in a liquid state, such that gravity aids the refrigerant's downward flow path, and, in the second tube row 134, the refrigerant is becoming more gaseous such that gravity has a minimal effect on the refrigerant's upward flow path. That is, gravity provides buoyancy to the vapor, helping separate liquid from vapor, and preventing liquid from exiting the evaporator.

Figure 9A:
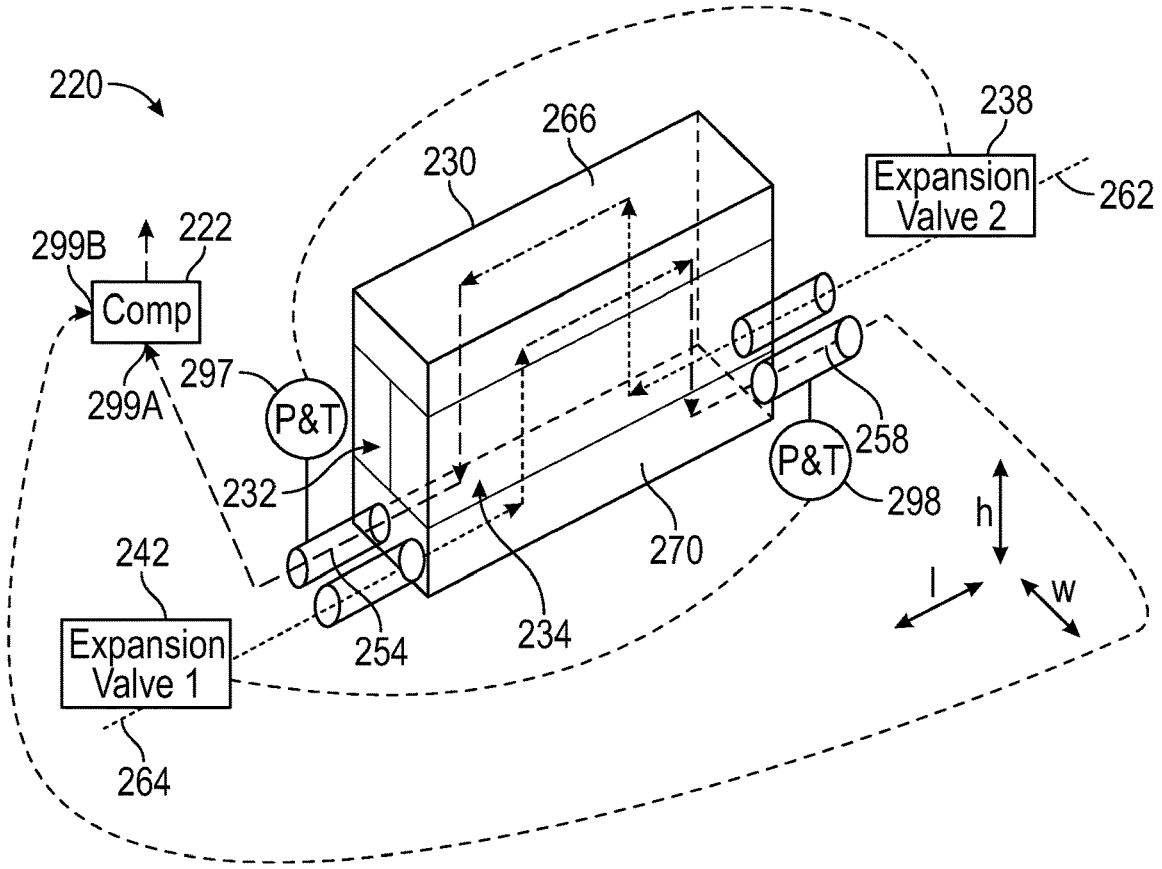
FIG. 9A schematically illustrates a section of another example HVAC system.

FIG. 9A illustrates another example refrigerant flow path through another example evaporator 230 in a section of an example HVAC system 220. A first path 262 flows through the expansion valve 238, enters the evaporator 230 through the second tank 270, flows in a heightwise direction through the first rube row 232 to the first tank 266, in an opposite heightwise direction back through the first tube row 232 (in some examples, through a different subsection of the first tube row 232) to the second tank 270 and exits the evaporator 230 from the second tank 270 at a tank end opposite lengthwise from the tank end at which it entered the second tank 270. A second path 264 flows through the expansion valve 242, enters the evaporator 230 through the second tank 270, flows in a heightwise direction through the second rube row 234 to the first tank 266, back in an opposite heightwise direction through the second tube row 234 (in some examples, through a different subsection of the second tube row 234) to the second tank 270, and exits the evaporator 230 from the second tank 270 at a tank end opposite lengthwise from the tank end at which it entered the second tank 270. In some examples, as shown, the paths 262, 264 enter and exit the tank 270 at different tank ends from one another. In some examples, this arrangement creates a relatively uniform temperature within the evaporator. In some examples, as shown, the paths 262 and 264 connect to the compressor 222 at different stages of compression. In some examples, as shown schematically, the path 262 may connect to the compressor at an inlet 299A and the path 264 may connect to the compressor 222 at a mid-cycle compression inlet 299B downstream on the inlet 299A with respect to the refrigerant path. In these examples, the expansion valves 238, 242 could be adjusted to vary the flow such that more refrigerant flow is allowed through the "air off" tube row 232 than the "air on" tube row 234. In some examples, more flow on the air off slab allows for better temperature uniformity, such as by providing a flooded core when refrigerant flows through the core as saturated liquid/vapor and never reaches a superheated state which maintains an equal temperature of the refrigerant at all locations in the core, leading to better temperature uniformity (assuming minimal pressure drop throughout the core because changing pressure changes refrigerant temperature). Further higher flow rate conditions may lead to better temperature uniformity.

In other examples, the paths 262 and 264 may connect to the compressor 222 at the same stage. In some examples, the other HVAC systems 20/120/320/420 disclosed herein could have similar compressor connections to those disclosed with this embodiment.

A pressure and temperature sensor 297 may be provided near the evaporator outlet 254 of the path 262 and in communication with the expansion valve 238 to communicate pressure and/or temperature parameters of the refrigeration near the evaporator outlet 254. In some examples, this communication may be either through a controller or one or more other intermediaries or directly, as shown schematically. A pressure and temperature sensor 298 may be provided near the evaporator outlet 258 of the path 264 and in communication with the expansion valve 242 to communicate pressure and/or temperature parameters of the refrigeration near the evaporator outlet 258, either through a controller or one or more other intermediaries or directly, as shown schematically. In some examples, the expansion valves 238/242 may be adjusted, such as to vary flow, in response to feedback from the respective sensors 297/298. In some examples, these adjustments may be automatic, such as by one or more controllers. The other HVAC systems disclosed herein may include pressure and temperature sensors arranged similarly to those disclosed in this embodiment.

Figure 9B:
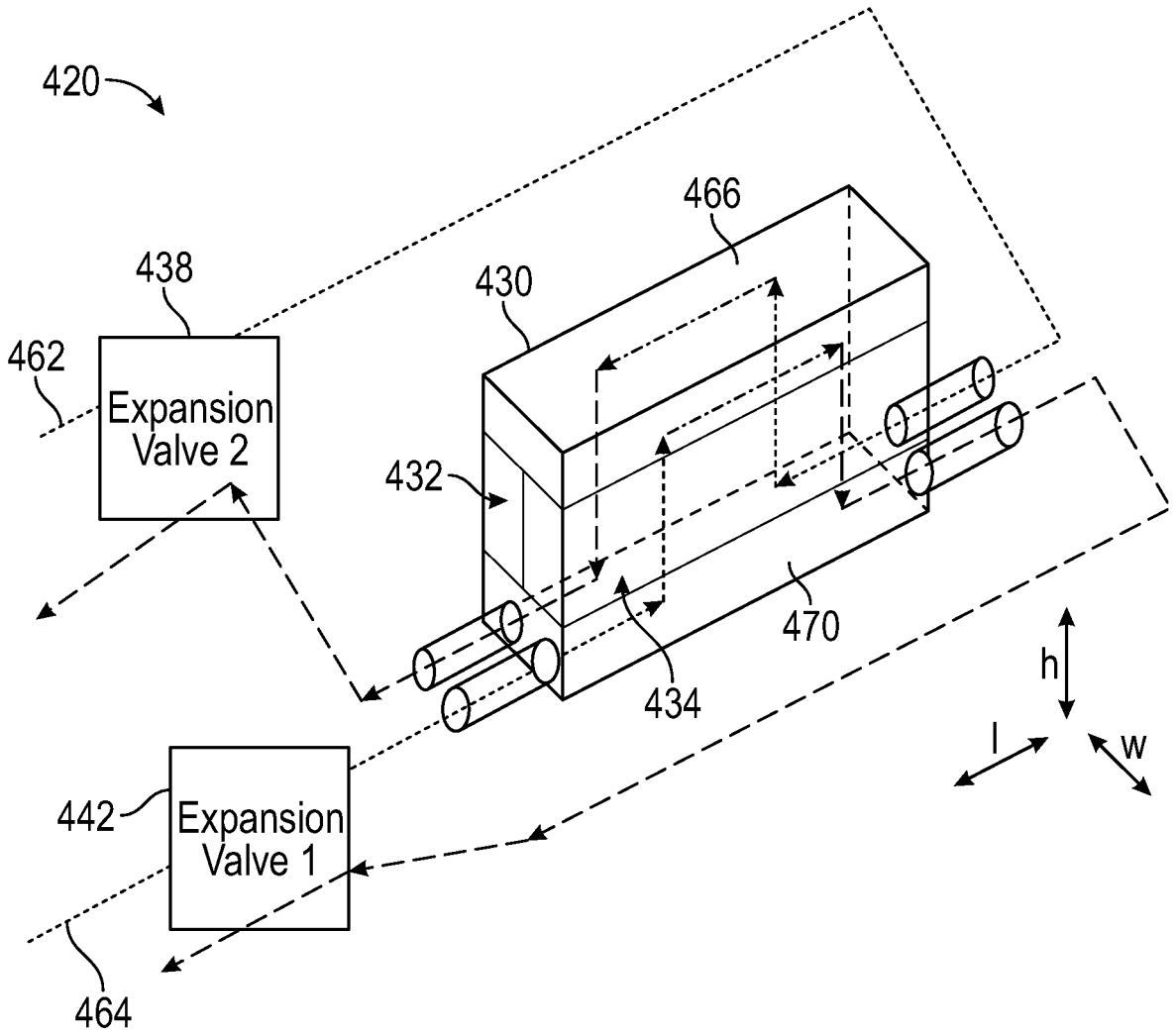
FIG. 9B schematically illustrates a section of another example HVAC system.

FIG. 9B schematically illustrates another example evaporator 430 in a section of an example HVAC system 420 and substantially identical to the evaporator 230 shown in FIG. 9A, except that mechanical expansion valves 438, 442 are utilized, such that the paths 262, 264 flow through their respective expansion valves 438, 442 both before entering the evaporator 430 and after exiting the evaporator 430. In some examples, such as those using mechanical valves, pressure and temperature sensors at the evaporator outlets are therefore not utilized.

Figure 10:
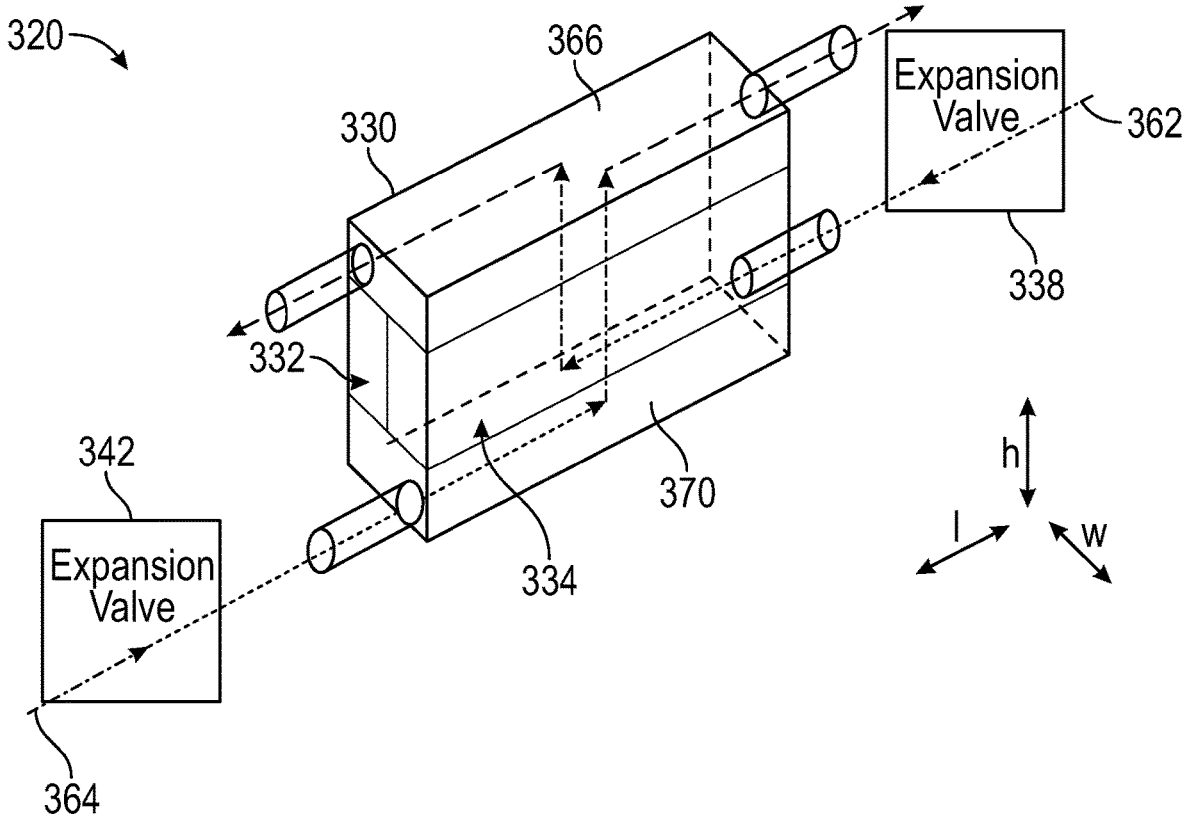
FIG. 10 schematically illustrates a section of another example HVAC system.

FIG. 10 schematically illustrates another example refrigerant flow path through another example evaporator 330 at a section of an example HVAC system 320. A first path 362 flows through the expansion valve 338, enters the evaporator 330 through the second tank 370, flows in a heightwise direction through the first rube row 332 to the first tank 366, and exits the evaporator 330 from the first tank 366. A second path 364 flows through the expansion valve 342, enters the evaporator 330 through the second tank 370, flows in a heightwise direction through the second rube row 334 to the first tank 366, and exits the evaporator from the first tank 366. The first path 362 enters the tank 370 at a tank end opposite lengthwise from the tank end where the second path 364 enters the tank 370. The first path 362 exits the tank 366 at a tank end opposite from the tank end where the second path 364 exits the tank 366. As discussed above, various partitions may be arranged in the respective tanks to achieve the flow paths shown.

Although the different examples are illustrated as having specific components, the examples of this disclosure are not limited to those particular combinations. It is possible to use some of the components or features from any of the embodiments in combination with features or components from any of the other embodiments.

The foregoing description shall be interpreted as illustrative and not in any limiting sense. A worker of ordinary skill in the art would understand that certain modifications could come within the scope of this disclosure. For these reasons, the following claims should be studied to determine the true scope and content of this disclosure.

What is claimed is:

1. An HVAC system, comprising an evaporator;

a condenser;

a compressor;

a first refrigerant path configured for flow beginning through a first expansion valve, then through a first evaporator inlet, then within the evaporator, and then out of the evaporator through a first evaporator outlet; and a second refrigerant path configured for flow beginning through a second expansion valve, then throuogh a second evaporator inlet, then within the evaporator, and then out of the evaporator through a second evaporator outlet, wherein the system is configured for refrigerant flow from the condenser to the first refrigerant path and the second refrigerant path, and for refrigerant flow from the first refrigerant path and the second refrigerant path to the compressor.

2. The system as recited in claim 1, comprising a receiver drier fluidly between, with respect to the flow of refrigerant, the condenser and the first and second expansion valves.

3. The system as recited in claim 1, wherein the evaporator includes a first tube row including a first plurality of evaporator tubes spaced apart from one another in a lengthwise direction and extending in a heightwise direction with respect to the evaporator, and a second tube row including a second plurality of evaporator tubes spaced apart from one another in the lengthwise direction and extending in a heightwise direction, and the first plurality of evaporator tubes is spaced from the second plurality of evaporator tubes in a widthwise direction.

4. The system as recited in claim 3, comprising a first tank at a first end of the first tube row and the second tube row, and a second tank at a second end of the first tube row and the second tube row and opposite the first end.

5. The system as recited in claim 4, further comprising a fan configured to move air in the widthwise direction across the evaporator, wherein the second tube row is an air on tube row with respect to the airflow of the fan, and the first tube row is an air off tube row with respect to the airflow of the fan, wherein the first evaporator inlet and the second evaporator inlet are disposed at the second tank, and the first evaporator outlet and the second evaporator outlet are disposed at the second tank.

6. The system as recited in claim 4, comprising a plurality of partitions within the first and second tanks configured to direct refrigerant flow within the evaporator and to keep the first refrigerant path and the second refrigerant path fluidly separate within the evaporator.

7. The system as recited in claim 1, wherein the first refrigerant path is configured for refrigerant flow to enter one of a first and second tank of the evaporator through the first evaporator inlet, flow through a first subsection of a first plurality of evaporator tubes of the evaporator in the heightwise direction to the other of the first and second tank, then through a first subsection of a second plurality of evaporator tubes of the evaporator in an opposite heightwise direction back to the one of the first and second tank, and to exit the evaporator through a first evaporator outlet on the one of the first and second tank.

8. The system as recited in claim 1, wherein the first refrigerant path and the second refrigerant path are configured to remain fluidly separate within the evaporator.

9. The system as recited in claim 1, wherein the first expansion valve is fluidly between, with respect to the flow of refrigerant, the condenser and the evaporator, and the second expansion valve is fluidly between, with respect to the flow of refrigerant, the condenser and the evaporator.

10. An HVAC system, comprising:

an evaporator including a first tube row including a first plurality of evaporator tubes spaced apart from one another in a lengthwise direction and extending in a heightwise direction with respect to the evaporator, and a second tube row including a second plurality of evaporator tubes spaced apart from one another in the lengthwise direction and extending in a heightwise direction, a first tank at a first end of the first tube row and the second tube row, and a second tank at a second end of the first tube row and the second tube row and opposite the first end, the first plurality of evaporator tubes spaced from the second plurality of evaporator tubes in a widthwise direction;

a condenser;

a compressor;

a first refrigerant path configured for flow through a first expension valve, a first evaporator inlet, within the evaporator, and out of the evaporator through the first evaporator outlet; and a second refrigerant path configured for flow through a second expansion valve, a second evaporator inlet, within the evaporator, and out of the evaporator through a second evaporator outlet, wherein the system is configured for refrigerant flow from the condenser to the first refrigerant path and the second refrigerant path, and for refrigerant flow from the first refrigerant path and the second refrigerant path to the compressor;

wherein the first refrigerant path is configured for refrigerant flow to enter one of the first and second tank through the first evaporator inlet, flow through a first subsection of the first plurality of evaporator tubes in the heightwise direction to the other of the first and second tank, then through a first subsection of the second plurality of evaporator tubes in an opposite heightwise direction back to the one of the first and second tank, and to exit the evaporator through the first evaporator outlet on the one of the first and second tank.

11. The system as recited in claim 10, wherein the second refrigerant path is configured for refrigerant flow to enter the of the first and second tank through the second evaporator inlet, flow through a second subsection of the first plurality of evaporator tubes in the heightwise direction to other of the first and second tank, then through a second subsection of the second plurality of evaporator tubes in the opposite heightwise direction back to the one of the first and second tank, and to exit the evaporator through the second evaporator outlet on one of the first and second tank.

12. The system as recited in claim 11, comprising a plurality of partitions within the first and second tanks configured to direct refrigerant flow within the evaporator and to keep the first refrigerant path and the second refrigerant path fluidly separate within the evaporator.

13. The system as recited in claim 11, wherein the first tube row, the second tube row, the first tank, and the second tank, are brazed together.

14. The system as recited in claim 11, wherein the first refrigerant path and the second refrigerant path have a mirrored relationship within the evaporator relative to a plane extending widthwise and heightwise through central portions of the first and second tube row.

15. The system as recited in claim 10, wherein the opposite heightwise direction is a downward direction.

16. The system as recited in claim 10, wherein the opposite heightwise direction is an upward direction.

17. The system as recited in a claim 10, wherein at least one of the first and second expansion valves are in communication with a controller to vary refrigerant flow through the at least one of the first and second expansion valves.

18. The system as recited in claim 10, wherein the first tube row, the second tube row, the first tank, and the second tank, are brazed together.

19. The system as recited in claim 10, including a plurality of fins extending in the lengthwise direction between adjacent ones of the first and second plurality of evaporator tubes and in the widthwise direction from the second tube row to the first tube row.

20. The system as recited in claim 10, wherein the first evaporator inlet and the second evaporator inlet are disposed at the second tank, and the first evaporator outlet and the second evaporator outlet are disposed at the second tank.

* * * * *